US006799543B2

(12) United States Patent
Lee et al.

(10) Patent No.: US 6,799,543 B2
(45) Date of Patent: Oct. 5, 2004

(54) VALVE DEACTIVATION SYSTEM WITH FREE MOTION SPRING

(75) Inventors: Jongmin Lee, Pittsford, NY (US); Kenneth J. Dauer, Avon, NY (US); Nick J. Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 236 days.

(21) Appl. No.: 09/755,290

(22) Filed: Jan. 5, 2001

(65) Prior Publication Data

US 2002/0088414 A1 Jul. 11, 2002

(51) Int. Cl.[7] ..... F01L 1/34

(52) U.S. Cl. ..... 123/90.16; 123/90.15; 123/90.39; 123/198 F

(58) Field of Search ..... 123/90.15–90.18, 123/90.39, 90.41, 90.44, 90.47, 198 F, 90.12, 90.16

(56) References Cited

U.S. PATENT DOCUMENTS

| | | | | | |
|---|---|---|---|---|---|
| 5,239,952 | A | * | 8/1993 | Morita | 123/90.16 |
| 5,544,628 | A | * | 8/1996 | Voigt | 123/198 F |
| 5,584,267 | A | * | 12/1996 | Muir | 123/198 F |
| 5,709,180 | A | | 1/1998 | Spath | |
| 5,832,891 | A | * | 11/1998 | Paul | 123/198 F |
| 5,890,469 | A | * | 4/1999 | Ha kansson et al. | 123/321 |
| 5,908,015 | A | | 6/1999 | Kreuter | |
| 5,992,360 | A | * | 11/1999 | Elendt et al. | 123/90.16 |
| 6,244,257 | B1 | * | 6/2001 | Hu | 123/568.14 |

FOREIGN PATENT DOCUMENTS

| | | |
|---|---|---|
| DE | 19744253 A | 4/1999 |
| DE | 19941367 A | 3/2000 |
| DE | 19914046 A1 | 9/2000 |
| FR | 2535390 A | 5/1984 |
| FR | 2535390 A1 | 5/1984 |
| JP | 11343821 | 3/2000 |

OTHER PUBLICATIONS

European Search Report—Mar. 2, 2003.

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A valve deactivation system includes a deactivation rocker arm assembly and a free motion spring assembly. The deactivation rocker arm assembly includes an elongate rocker arm defining an aperture. A center post is slidingly disposed within the aperture. The center post is configured for engaging a valve stem of a valve of an internal combustion engine. Coupling means selectively couple together and decouple the center post and the rocker arm. The free motion spring assembly includes an inner spring retainer surrounding a portion of the valve stem. An outer spring retainer surrounds a portion of the valve stem. An inner spring surrounds a portion of the valve stem between the inner spring retainer and a disk cap associated with the valve stem. An outer spring surrounds the inner spring.

4 Claims, 4 Drawing Sheets

VALVE DEACTIVATION SYSTEM WITH FREE MOTION SPRING

TECHNICAL FIELD

The present invention relates to a valve deactivation system for use with internal combustion engines.

BACKGROUND OF THE INVENTION

Generally, cylinder deactivation is the deactivation of the intake and/or exhaust valves of a cylinder or cylinders in an internal combustion engine during at least a portion of the combustion process. Deactivating one or more cylinders reduces pumping work and is a proven method by which fuel economy can be improved. In effect, cylinder deactivation reduces the number of engine cylinders within which the combustion process is taking place. With fewer cylinders performing combustion, fuel efficiency is increased. Cylinder deactivation is particularly effective during part-load conditions when full engine power is not required for smooth and efficient engine operation. Studies have shown that cylinder deactivation can improve fuel economy by as much as fifteen percent.

Conventional devices used to achieve cylinder deactivation are typically moderately complex mechanical devices assembled from numerous subassemblies and component parts. The assembly of a device from numerous component parts requires significant labor and the need to inventory and maintain a supply of the various component parts, thereby increasing the cost of manufacture. Furthermore, the numerous component parts used in a conventional cylinder deactivation device contribute mass to the device, may impact the reliability of the device, and may limit the performance of the device to a limited range of engine operation.

The additional component parts, such as, for example, multiple springs, arms and shaft members used in a conventional cylinder/valve deactivation system have typically not fit within the space occupied by standard drive train components. Therefore, the conventional methods of implementing cylinder deactivation have required modification and redesign of valve trains and engines to provide the needed space within which to house the additional deactivation components. Furthermore, it has typically been necessary to custom design a unique cylinder/valve deactivation system for each particular model of engine. Thus, substantial amounts of research and development, engineering resources, and testing were required in order to develop a unique system for each type or model of engine.

Therefore, what is needed in the art is a cylinder deactivation device which is designed to more readily fit within existing space occupied by standard drive train components, thereby avoiding the need to redesign engines and their valve trains.

Furthermore, what is needed in the art is a cylinder deactivation device that is relatively simple and uses fewer component parts, and is therefore manufactured in a more cost-effective manner.

Even further, what is needed in the art is a cylinder deactivation device which can be used with a variety of valve train configurations, thereby reducing the need to design a unique valve/cylinder deactivation system for each engine model.

Moreover, what is needed in the art is a cylinder deactivation device which utilizes conventional valve train components as part of the deactivation system, and enables cylinder deactivation over a wide range of engine operation.

SUMMARY OF THE INVENTION

The present invention provides a valve deactivation system for use with an internal combustion engine.

The invention comprises, in one form thereof, a deactivation rocker arm assembly and a free motion spring assembly. The deactivation rocker arm assembly includes an elongate rocker arm defining an aperture. A center post is slidingly disposed within the aperture. The center post is configured for engaging a valve stem of a valve of an internal combustion engine. Coupling means selectively couple together and decouple the center post and the rocker arm The free motion spring assembly includes an inner spring retainer surrounding a portion of the valve stem. An outer spring retainer surrounds a portion of the valve stem. An inner spring surrounds a portion of the valve stem between the inner spring retainer and a disk cap associated with the valve stem. An outer spring surrounds the inner spring.

An advantage of the present invention is that it is more readily fits within existing space occupied by standard drive train components, and thereby avoids the need to redesign engines and/or engine valve trains.

Another advantage of the present invention is that it uses fewer component parts, and is therefore manufactured in a cost-effective manner.

Yet another advantage of the present invention is that it can be used with a variety of conventional valve train configurations, and thereby reduces the need to design a unique valve/cylinder deactivation system for each engine model.

A still further advantage of the present invention is the conventional valve spring of the internal combustion engine is utilized as a component of the valve deactivation system, thereby reducing the complexity of the system.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENTS

Figure 1:
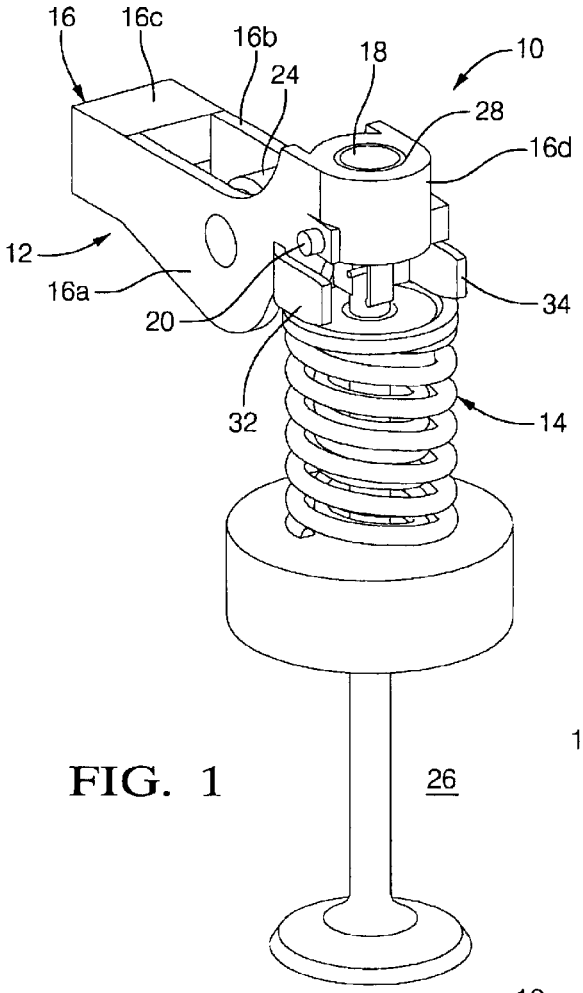
FIG. 1 is a perspective view of one embodiment of a valve deactivation system of the present invention.
Figure 2:
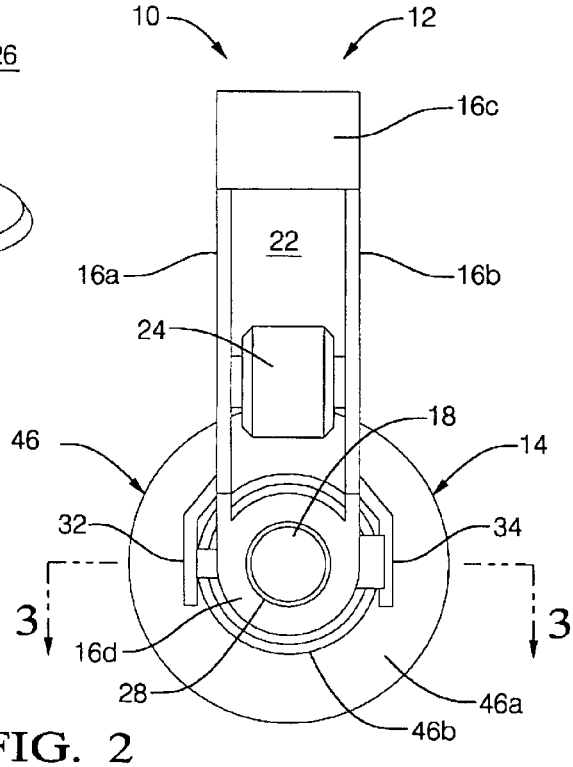
FIG. 2 is a top view of the valve deactivation system of FIG. 1.

Referring now the drawings, and particularly to FIGS. 1–3, there is shown one embodiment of the valve deactivation system of the present invention. Generally, and as will be described more particularly hereinafter, valve deactivation system 10 is switchable between a default state and a deactivated state to thereby selectively activate and deactivate, respectively, a corresponding valve/cylinder of an internal combusting engine. In the default (or activated) state, rotary motion of the cam of an internal combustion engine is transferred by valve deactivation system 10 to reciprocation of an intake valve of the engine. In the deactivated state, the rotary motion of the cam is not transferred to reciprocation of the valve. Rather, the rotary motion of the cam is absorbed by valve deactivation system 10. Valve deactivation system 10 includes deactivation rocker arm assembly 12 and free motion spring assembly 14.

Deactivation rocker arm assembly 12 includes rocker arm 16, center post 18 and locking pin assembly 20. Rocker arm 16 has an elongate body which includes side walls 16*a*, 16*b*, between which is defined roller orifice 22. Roller 24 is disposed within roller orifice 22 and is connected, such as, for example, by a shaft, to each of side walls 16*a*, 16*b*. Rocker arm 16 further includes first end 16*c* and second end 16*d*. First end 16*c* is configured to engage a lash adjuster, such as, for example, a hydraulic lash adjuster (not shown) of internal combustion engine 26, and thus may include a semi-spherical lash adjuster socket. Second end 16*d* is substantially cylindrical and defines aperture 28 therethrough. Substantially cylindrical pin bores 30*a*, 30*b* (FIGS. 3A and 3B) are defined on opposite sides of second end 16*d*. Arms 32, 34 are elongate members which extend in a generally parallel manner relative to, and a predetermined distance from, side walls 16*a*, 16*b*, respectively. Arms 32, 34 are, for example, formed integrally with or attached to side walls 16*a*, 16*b*. Rocker arm 16 is constructed of, for example, steel, carbon steel or an alloy.

Center post 18 is disposed within aperture 28 of second end 16*d* of rocker arm 16. Center post 18 is dimensioned such that there is a small gap or clearance defined between center post 18 and the inside surface (not referenced) of aperture 28. Center post 18 defines pin bore 36 therethrough. Center post 18 is configured to engage valve stem 38 of engine 26, and thus includes a valve stem seat (not shown) or other suitable structural feature to interface with and/or receive valve stem 38. Center post 18 is selectively coupled to and decoupled from rocker arm 16 by locking pin assembly 20.

Locking pin assembly 20 includes actuator pin 20*a*, middle pin member 20*b*, outer pin member 20*c*, and pin spring 20*d*. Locking pin assembly 20 is switchable between a default/activated state and a deactivated/decoupled state. In each of the default state and the decoupled state, actuator pin 20*a* is slidingly disposed at least partially within pin bore 30*a*, middle pin member 20*b* is slidingly disposed at least partially within pin bore 36 of center post 18, and outer pin member 20*c* is slidingly disposed at least partially within pin bore 30*b*. Pin spring 20*d* is disposed within pin bore 30*b* and is compressed between outer pin member 20*c* and the inside wall (not referenced) of pin bore 30*b*. Pin spring 20*d* normally biases each of actuator pin 20*a*, middle pin member 20*b* and outer pin member 20*c* into the default position. Each of actuator pin 20*a*, middle pin member 20*b* and outer pin member 20*c* are, for example, substantially cylindrical pin members constructed of steel, carbon steel, or alloy steel. Pin spring 20*d* is configured as, for example, a coil spring constructed of piano wire or chrome silicon.

Free motion spring assembly 14 includes outer spring 42, inner spring 44, outer spring retainer 46 and inner spring retainer 48. Each of outer spring 42 and inner spring 44 are configured as, for example, coil springs. Outer spring 42 surrounds inner spring 44 between outer spring retainer 46 and disk cap 50, and exerts spring force F1 upon outer spring retainer 46. Outer spring retainer 46 is a substantially cylindrical collar-like member, and includes collar portion 46*a*, rim 46*b*, and guide wall portion 46*c* extending perpendicularly from collar portion 46*a*. Collar portion 46*a* is seated upon outer spring 42, and guide wall portion 46*c* extends downward therefrom in the direction of disk cap 50. Arms 32 and 34 of rocker arm 16 engage collar portion 46*a* of outer spring retainer 46 on the side opposite outer spring 42. Guide wall portion 46*c* is disposed between outer spring 42 and inner spring 44.

Inner spring 44 surrounds valve stem 38. Inner spring 44 is disposed between and engages inner spring retainer 48 and disk cap 50. Inner spring retainer 48 is a substantially cylindrical collar-like member having a collar portion 48*a* and sleeve portion 48*b*. Inner spring retainer 48 engages stem groove 38*a* of valve stem 38 to thereby couple together valve stem 38 and inner spring retainer 48. Thus, valve stem 38 and inner spring retainer 48 move (i.e., reciprocate) as substantially one body, and movement of valve stem 38 results in inner spring retainer 48 compressing/decompressing inner spring 44. Rim 46*b* of outer spring retainer 46 is biased by outer spring 42 into abutting engagement with the periphery of collar portion 48*a* of inner spring retainer 48 to thereby limit axial movement of outer spring retainer 46 relative to inner spring retainer 48.

In use, valve deactivation system 10 is switchable between a default state and a deactivated state by an associated actuating device (not shown). Generally, rotary motion of a cam (not shown) of internal engine 26 is transferred into reciprocal motion of rocker arm 16. With valve deactivation system 10 in the default state, rocker arm 16 and center post 18 are coupled together and thus reciprocate as substantially one body to thereby reciprocate valve stem 38 and actuate the valve associated therewith. In the deactivated state, center post 18 is decoupled from rocker arm 16 such that rocker arm 16 reciprocates relative to center post 18. Thus, the reciprocation of rocker arm 16 is not transferred by center post 18 to valve stem 38, and the associated valve is deactivated.

Figure 3A:
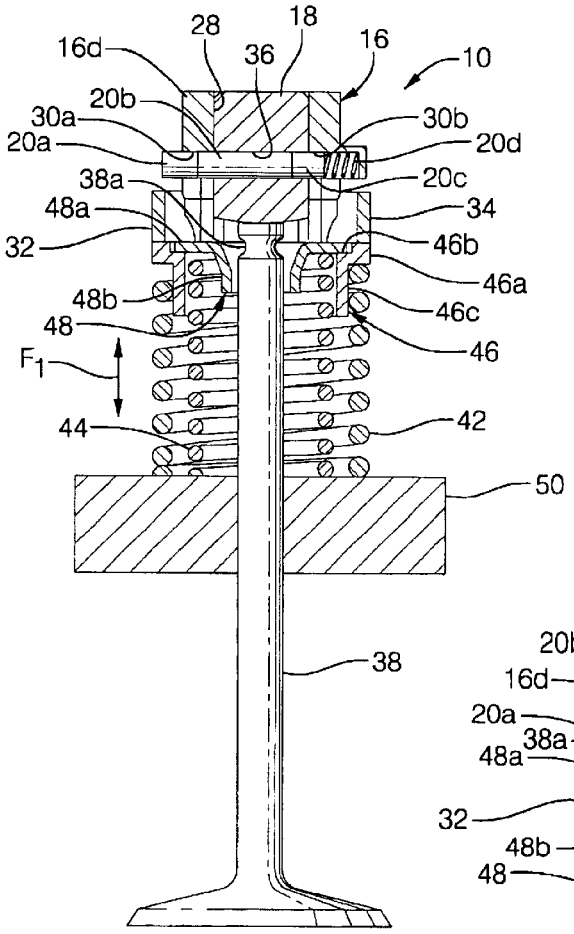
FIG. 3A is a sectioned view of the valve deactivation system of FIG. 1 in the default condition.

Valve deactivation system 10 is shown in the default state in FIG. 3A, wherein center post 18 and rocker arm 16 are coupled together by locking pin assembly 20 and are reciprocated as substantially one body to thereby actuate a valve of engine 26. More particularly, pin spring 20*d* normally biases a portion of outer pin member 20*c* into disposition within pin bore 36 of center post 18. Thus, outer pin member 20*c* is disposed within each of pin bore 30*b* and pin bore 36 thereby coupling center post 18 to second end 16*d* of rocker arm 16. The biasing of a portion of outer pin member 20*c* into disposition within pin bore 36 of center post 18 displaces or biases a portion of middle pin member 20*b* into disposition within pin bore 30*a*. Thus, middle pin member 20*b* is disposed within each of pin bore 36 and pin bore 30*a* to thereby further couple center post 18 to second end 16*d* of rocker arm 16. Thus, in the default position, center post 18 is securely coupled in two places to second end 16*d* of rocker arm 16 by locking pin assembly 20. Therefore, center post 18 and rocker arm 16 reciprocate as substantially one body when locking pin assembly 20 is in the default position.

A cam of internal combustion engine 26 engages roller 24 of deactivation rocker arm assembly 14. With locking pin assembly 20 in the default position, the rotational movement of the cam is transferred to pivotal movement of rocker arm 16 to thereby actuate a corresponding valve of internal combustion engine 26. More particularly, arms 32 and 34 of rocker arm 16 are in abutting engagement with collar portion 46*a* of outer spring retainer 46, and transfer reciprocation of rocker arm 16 to reciprocation of outer spring retainer 46 thereby compressing outer spring 42. As stated above, with locking pin assembly 20 in the default position rocker arm 16 and center post 18 are coupled together and reciprocate as substantially one body. Thus, reciprocation of rocker arm 16 results in the reciprocation of center post 18. Center post 18 transfers the reciprocal motion to valve stem 38 which, in turn, reciprocates inner spring retainer 48 thereby compressing inner spring 44. Therefore, with locking pin assembly 20 in the default position, pivotal movement of rocker arm 16 is transferred to reciprocal movement of each of center post 18, outer spring retainer 46, inner spring retainer 48 and valve stem 38, and to compression of outer spring 42 and inner spring 44. Spring force F1 maintains roller 24 in contact with the cam of engine 26, and thus outer spring 42 functions as a conventional valve spring when locking pin assembly 20 is in the default position.

In the default state, pin spring 20*d* biases a portion of actuator pin member 20*a* out of pin bore 30*a* in a direction away from center post 18. An actuating device (not shown), such as, for example, a hydraulic piston or actuating solenoid, is disposed in association with actuator pin member 20*a*. The actuating device is disposed, for example, adjacent to or in abutting engagement with actuator pin member 20*a*. The actuating device limits the outward biasing by pin spring 20*d* of actuator pin member 20*a*. Valve deactivation system 10 is switched from the default state into the decoupled state by the actuating device overcoming the biasing of pin spring 20*d* and displacing actuator pin member 20*a* a predetermined distance within pin bore 30*a* in a direction toward center post 18.

Figure 3B:
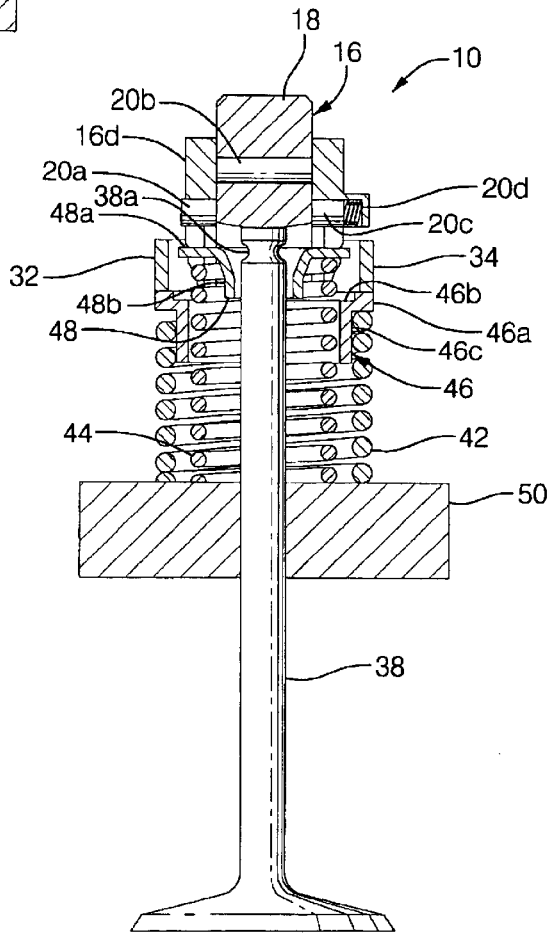
FIG. 3B is a sectioned view of the valve deactivation system of FIG. 1 in the deactivated or decoupled state.

The deactivated or decoupled state of valve deactivation system 10 is shown in FIG. 3B. Actuator pin member 20*a* is displaced a predetermined distance within pin bore 30*a* in a direction toward center post 18. The displacement of actuator pin member 20*a* toward center post 18, in turn, displaces middle pin member 20*b* from disposition within pin bore 30*a* and disposes middle pin member 20*b* substantially entirely within pin bore 36 of center post 18 to thereby decouple center post 18 from second end 16*d* of rocker arm 16. The predetermined amount of travel or displacement of actuator pin member 20*a* is such that the interface between actuator pin 20*a* and middle pin member 20*b* is disposed within the small gap defined between aperture 28 and center post 18. The displacement of middle pin member 20*b*, in turn, displaces outer pin member 20*c* from disposition within pin bore 36 of center post 18 and disposes outer pin member 20*c* substantially entirely within pin bore 30*b* to thereby decouple center post 18 from side wall 16*b*. The interface between outer pin member 20*c* and middle pin member 20*b* is disposed within the small gap defined between aperture 28 and center post 18.

Thus, in the deactivated or decoupled position, center post 18 is decoupled from each of side walls 16*a* and 16*b* by the actuating device biasing locking pin assembly 20 out of the default position and into the deactivated position. With locking pin assembly 20 in the decoupled or deactivated state/position, rocker arm 16 is slidable relative to center post 18. Thus, rocker arm 16 and center post 18 no longer reciprocate as substantially one body. Rather, with center post 18 decoupled from rocker arm 16, rocker arm 16 reciprocates relative to center post 18. Rotary motion of the cam of engine 26 is transferred to reciprocation of rocker arm 16 but is not transferred to reciprocation of center post 18. Arms 32 and 34 of rocker arm 16 transfer the reciprocation of rocker arm 16 to reciprocation of outer spring retainer 46 and compression of outer spring 42. Center post 18, being decoupled from rocker arm 16, does not move in conjunction with rocker arm 16. Thus, inner spring retainer 48 and valve stem 38 are not reciprocated, nor is inner spring 44 compressed. With locking pin assembly 20 in the decoupled position, the compression of outer spring 42 absorbs the reciprocation of rocker arm 16. Thus, outer spring 42 serves as a lost motion spring.

It should be noted that outer spring 42 serves the function of a conventional valve spring by maintaining roller 24 in contact with the cam when locking pin assembly 20 is in the default position, and functions as a lost motion spring by absorbing the reciprocation of rocker arm 16 when locking pin assembly 20 is in the deactivated position. Thus, valve deactivation system 10 utilizes a conventional valve spring, i.e., outer spring 42, to perform the functions of a conventional valve spring and a lost motion spring. Valve deactivation system 10 thereby eliminates the need for a discrete lost motion spring.

Figure 4:
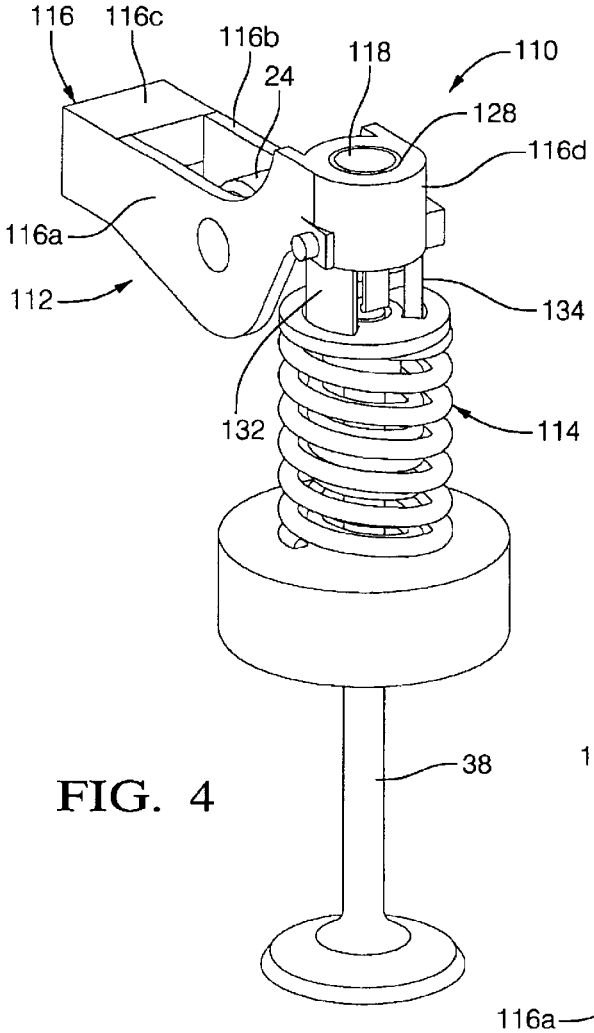
FIG. 4 is a perspective view of a second embodiment of a valve deactivation system of the present invention.
Figure 5:
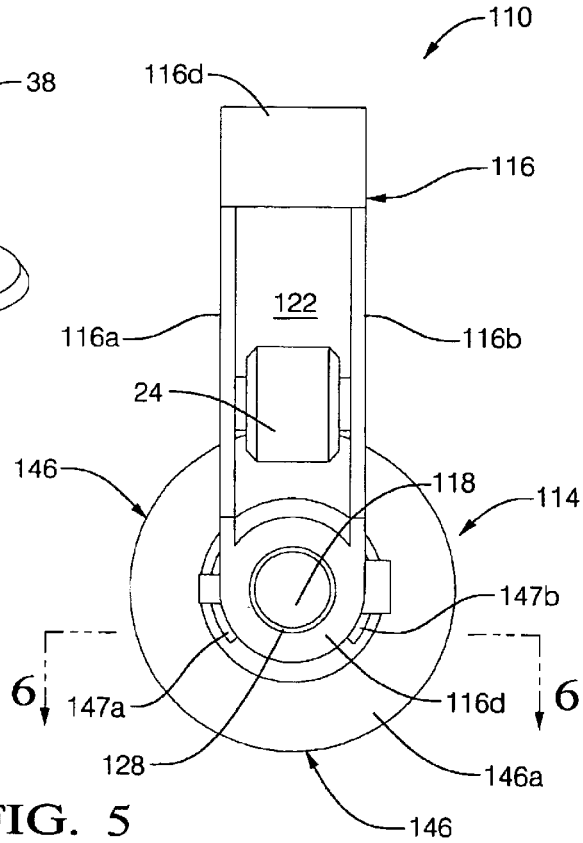
FIG. 5 is a top view of the valve deactivation system of FIG. 4.

Referring now to FIGS. 4–6, a second embodiment of a valve deactivation system of the present invention is shown. Valve deactivation system 110 is generally similar to, and operates in a generally similar manner as, valve deactivation system 10. Therefore, only the differences in structure and operation of valve deactivation system 110 relative to valve deactivation system 10 are discussed below.

Deactivation rocker arm assembly 112 is generally similar to deactivation rocker arm assembly 12, as discussed above, and includes side walls 116*a*, 116*b*, first end 116*c* and second end 116*d*. Substantially cylindrical pin bores 130*a*, 130*b* are defined on opposite sides of second end 116*d*. Arms 132, 134 are elongate members which, in contrast to arms 32 and arms 34 of deactivation rocker arm assembly 12, extend from opposite sides of the bottom surface (not referenced) of second end 116*d* of rocker arm 116 for a predetermined distance in a direction toward disk cap 50 and in a manner that is generally parallel with valve stem 38.

Free motion spring assembly 114 includes outer spring 142, inner spring 144, outer spring retainer 146 and inner spring retainer 148. Outer spring 142 is disposed between and in abutting engagement with disk cap 50 and outer spring retainer 142, and surrounds inner spring 144. Inner spring 144 is disposed between and in abutting engagement with inner spring retainer 148 and disk cap 50, and surrounds valve stem 38. Outer spring 142 and inner spring 144 are substantially concentric relative to each other, with inner spring 144 being disposed between outer spring 142 and valve stem 38.

Outer spring retainer 146 is a substantially cylindrical collar-like member, and includes collar portion 146*a* and sleeve portion 146*c* which extends in a generally perpendicular manner from collar portion 146*a*. Collar portion 146*a* defines slots 147*a*, 147*b*, through which arms 132, 134 extend to engage inner spring retainer 148. Outer spring 142 abuttingly engages collar portion 146*a* of outer spring retainer 146. Outer spring retainer 146 engages stem groove 38*a* of valve stem 38 to thereby couple valve stem 38 and outer spring retainer 146 together. Thus, valve stem 38 and outer spring retainer 146 move as substantially one body. Valve stem 38 extends through sleeve portion 146*c*.

Inner spring retainer 148 is a substantially cylindrical collar-like member having a collar portion 148*a* and sleeve portion 148*b*. Inner spring retainer 148 is disposed on the outside of and below outer spring retainer 146. More particularly, sleeve portion 148*b* is disposed outside of sleeve portion 146*c* of outer spring retainer 146 relative to valve stem 38, and is adjacent to and generally parallel with sleeve portion 146*c*. Similarly, collar portion 148*a* is disposed below and adjacent to collar portion 146*a* of outer spring retainer 146 relative to aims 132, 134. Inner spring 144 abuttingly engages collar portion 148*a* of inner spring retainer 148.

Figure 6A:
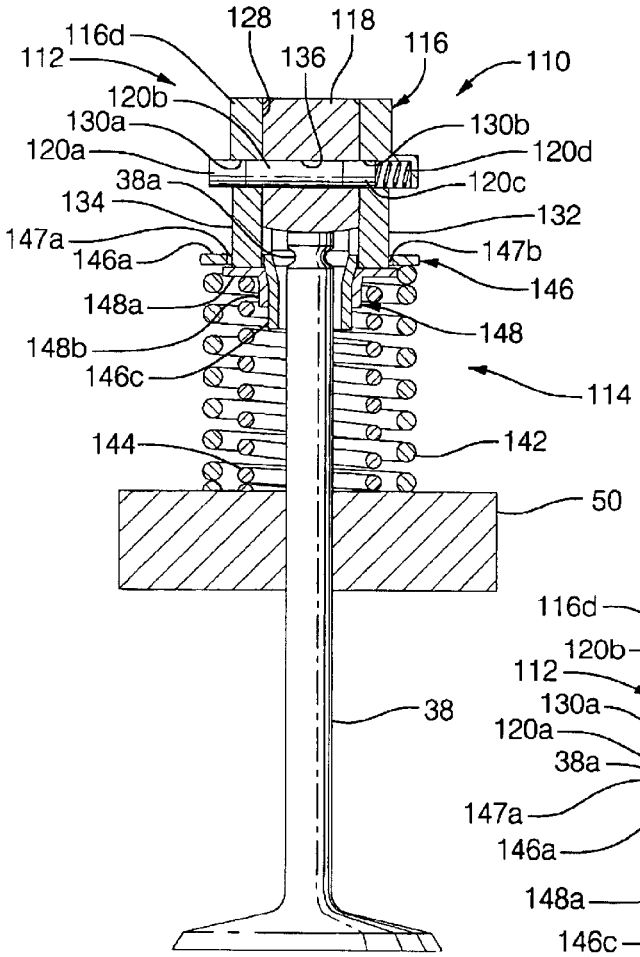
FIG. 6A is a sectioned view of the valve deactivation system of FIG. 4 in the default condition.

In use, and with valve deactivation system 110 in the default/activated state as shown in FIG. 6A, center post 118 and rocker arm 116 are coupled together by locking pin assembly 120, and are reciprocated as substantially one body by the cam of engine 26 to thereby reciprocate valve stem 38. More particularly, arms 134*a* and 134*b* extend through slots 147*a*, 147*b*, respecitvely, of outer spring retainer 146 to engage collar portion 148*a* of inner spring retainer 148 thereby transferring the reciprocation of deactivation rocker arm 16 to inner spring retainer 146 and compressing inner spring 144. Center post 118, reciprocating as substantially one body with rocker arm 116, transfers the reciprocation of rocker arm 116 to valve stem 38. As stated above, outer spring retainer 146 is coupled to valve stem 38 and thus is reciprocated in conjunction therewith. Reciprocation of outer spring retainer 146 compresses outer spring 142.

Figure 6B:
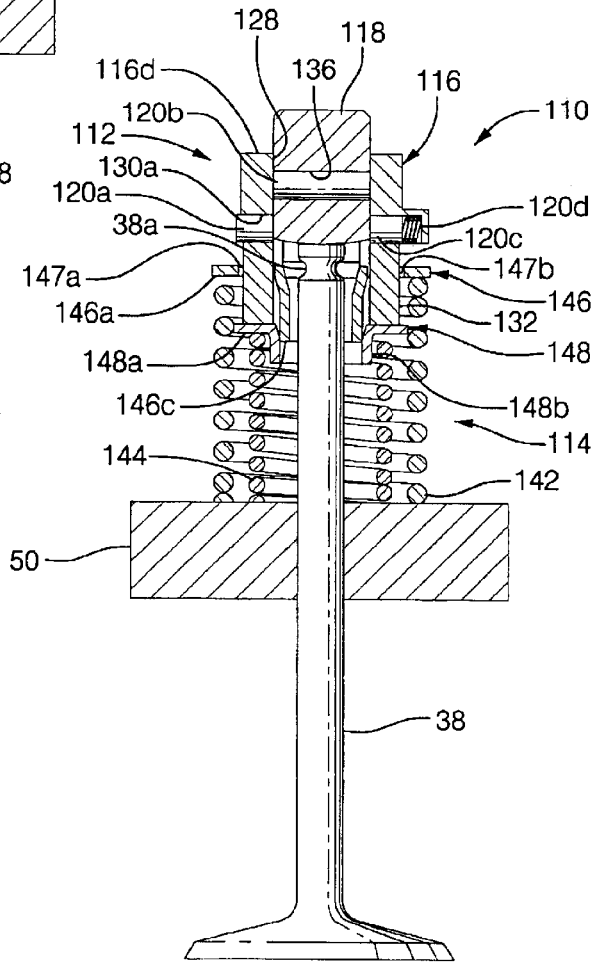
FIG. 6B is a sectioned view of the valve deactivation system of FIG. 4 in the deactivated or decoupled state.

The deactivated or decoupled state of valve deactivation system 110 is shown in FIG. 6B. With valve deactivation assembly 110 in the deactivated or decoupled position, rotary motion of the cam of engine 26 is not transferred to pivotal movement of deactivation rocker arm assembly 16 and thus the corresponding valve of internal combustion engine 26 is not reciprocated or actuated. More particularly, rocker arm 16 and center post 18 are no longer coupled together by locking pin assembly 120, and therefore no longer reciprocate as substantially one body. Rather, rocker arm 116 undergoes movement relative to center post 118. Rotary motion of the cam of engine 26 is transferred to reciprocation of rocker arm 116 but is not transferred to reciprocation of center post 118. Arms 132 and 134 of rocker arm 116 transfer the reciprocation of rocker arm 116 to reciprocation of inner spring retainer 148 and compression of inner spring 144. Center post 118, being decoupled from rocker arm 116, does not move in conjunction with rocker arm 116. Thus, valve stem 38 and outer spring retainer 146 are not reciprocated, nor is outer spring 142 compressed. With locking pin assembly 120 in the decoupled position, inner spring 144, absorbs the reciprocation of rocker arm 116 and thereby serves as a lost motion spring.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A valve deactivation system, comprising:

a deactivation rocker arm assembly including an elongate rocker arm, an aperture defined by said rocker arm, a center post slidingly disposed within said aperture, said center post configured for engaging a valve stem of a valve of an internal combustion engine, a locking pin assembly having an actuating pin member, a second pin member and a middle pin member selectively coupling together and decoupling said center post and said rocker arm; and a free motion spring assembly including:

an inner spring retainer surrounding a portion of the valve stem;

an outer spring retainer surrounding a portion of the valve stem;

an inner spring surrounding a portion of the valve stem, said inner spring being disposed between a disk cap associated with the valve stem and said inner spring retainer; and an outer spring surrounding said inner spring, said outer spring being disposed between said outer spring retainer and the disk cap, wherein said rocker arm includes elongate arms, said arms being one of attached to and integral with a body of said rocker arm and extending therefrom, said arms engaging one of said inner spring retainer and said outer spring retainer.

2. The valve deactivation system of claim 1, wherein said arms extend in a direction that is generally parallel with said body of said rocker arm, said outer spring biasing said outer spring retainer into engagement with said arms, said inner spring retainer configured for being coupled to the valve stem.

3. The valve deactivation system of claim 2, wherein said outer spring retainer includes a rim, said outer spring normally biasing said rim into engagement with a periphery of said inner spring retainer.

4. A valve deactivation system, comprising:

a deactivation rocker arm assembly including an elongate rocker arm having an end, an aperture defined by said end, a center post slidingly disposed within said aperture, said center post configured for engaging a valve stem of a valve of an internal combustion engine, said end of said rocker arm defining a first pin bore and a second pin bore, said first pin bore and said second pin bore being substantially concentric relative to each other, said center post defining a middle pin bore, wherein said deactivation rocker arm assembly further comprises a pin spring disposed within said second pin bore;

a locking pin assembly selectively coupling together and decoupling said center post and said rocker arm, said locking pin assembly including an actuating pin, a second pin member and a middle pin member, said actuating pin member slidingly disposed at least partially within said first pin bore, said second pin member slidingly disposed at least partially within said second pin bore, and said middle pin member slidingly disposed at least partially within said middle pin bore; and a free motion spring assembly, wherein said pin spring normally biases said locking pin assembly toward a default position wherein said actuator pin member extends a predetermined distance from disposition within said first pin bore in a direction away from said center post, said middle pin member extends from disposition within said middle pin bore into said first pin bore, and said second pin member extends from disposition within said second pin bore into said middle pin bore to thereby couple said center post to said rocker arm.

* * * * *